US005426924A

United States Patent [19]

Harty

[11] Patent Number: 5,426,924

[45] Date of Patent: Jun. 27, 1995

[54] PROTECTIVE GUARD FOR A NON-RUB COVER FOR A SADDLE CINCH OR GIRTH

[76] Inventor: Christopher Harty, Rte. 1, Box 144A, Fredericksburg, Tex. 78624

[21] Appl. No.: 155,708

[22] Filed: Nov. 22, 1993

[51] Int. Cl.[6] ..... B68C 1/14

[52] U.S. Cl. ..... 54/23

[58] Field of Search ..... 54/4, 23, 35, 46.1; 2/322

[56] References Cited

U.S. PATENT DOCUMENTS

| | | | |
|---|---|---|---|
| 1,112,708 | 10/1914 | Littlefield . | |
| 1,678,373 | 7/1928 | Wiesenfeld | 54/23 |
| 2,085,674 | 6/1937 | Sidell | 54/23 |
| 3,466,852 | 9/1969 | Stoner | 54/65 |
| 3,805,491 | 4/1974 | Deal | 54/23 |
| 3,828,521 | 8/1974 | Dulaney | 54/23 |
| 4,147,015 | 4/1979 | Land | 54/23 |
| 4,570,424 | 2/1986 | Simpson | 54/23 |
| 5,134,836 | 8/1992 | Harty | 54/23 |

FOREIGN PATENT DOCUMENTS

| | | | |
|---|---|---|---|
| 3602601 | 7/1987 | Germany | 54/23 |
| 21462 | 1/1892 | United Kingdom | 54/23 |
| 254034 | 7/1926 | United Kingdom | 54/23 |
| 2229346 | 9/1990 | United Kingdom | 54/23 |

OTHER PUBLICATIONS

Western Horseman; August 1992; p. 108; Softsides Cinches (Ortho-Flex Saddle Co.).

Western Horseman; July 1990; p. 95; Ortho-Flex ad.

Western Horseman; February 1991; p. 120; Ortho-Flex ad.

Western Horseman; June 1991; p. 95; Article reviewing Ortho-Flex Girth.

Western Horseman; April 1993; p. 6; Schneider's Neoflex Girth.

Ortho-Flex Catalog of Western and English Saddles and Accessories; p. 50; Cinch and girth Models B through E; represented to Undersigned to have a publication date of 1992.

Ortho-Flex Catalog of Custom Saddles and Accessories; p. 20E-Cinch and Girth Models B through E; p. 22E-Softsides Girths Represented to the Undersigned to have a publication date of 1993.

Chem Tac, Inc., Catalog, p. 1; "Pro-Flex Neoprene Girth".

Ortho-Flex Catalog; p. 6; Girth Models 1 through 3; Represented to Applicant and Undersigned as Having a Publication Date of 1989.

Western Horseman Catalog p. 6; Jul. 1993; Softsides Girths.

*Primary Examiner*—Robert P. Swiatek

*Attorney, Agent, or Firm*—Barnes & Thornburg

[57] ABSTRACT

A cinch or girth assembly for attaching a saddle to an animal includes a cinch or girth having structure secured thereto for connecting to a saddle. The assembly also includes an elastomeric sheet of non-rub material that is positioned to lie between the animal and the cinch or girth to help reduce abrasive contact between the cinch or girth and the animal. The assembly further includes a protective guard with a wear-resistant sheet made from a different material than that of the elastomeric sheet. Structure is provided for attaching the guard to the elastomeric sheet so that the guard lies away from the animal and extends adjacent a longitudinal length of the cinch or girth. In preferred embodiments, the elastomeric sheet is made of neoprene and the protective guard is made from leather, nylon, or jersey material.

45 Claims, 2 Drawing Sheets

PROTECTIVE GUARD FOR A NON-RUB COVER FOR A SADDLE CINCH OR GIRTH

BACKGROUND OF SUMMARY OF THE INVENTION

The present invention relates to a cinch or girth assembly for attaching a saddle to an animal. More particularly, the present invention relates to a cinch or girth assembly having an elastomeric sleeve or non-rub cover with a protective guard attached to a portion of an outer periphery of the sleeve or cover. A web assembly having buckles secured thereto is disposed within the sleeve or cover so that an unguarded portion of the outer periphery of the sleeve or cover lies adjacent the animal.

Cinches or girths are used to attach a saddle to an animal. Cinches or girths partially encircle the underside of an animal such as a horse near the front legs. These cinches or girths have a pair of buckles at each end which engage straps of the saddle. Such cinches or girths additionally include a pair of rings in the middle. One of these rings attaches to a tie down or, alternatively, to a breast collar of the saddle. The other ring attaches to a flank strap of a girth on the back of the saddle.

Sleeves or non-rub covers for saddle cinches or girths are known. The sleeve or cover is slid over the cinch or girth and, optionally, the buckles. See, for example, U.S. Pat. No. 5,134,836 issued to applicant of the present invention. These sleeves or covers are made from a soft elastomeric material such as neoprene that helps reduce abrasive contact between the cinch or girth and the animal.

A problem with such sleeves or covers is that outer peripheral portions not in contact with the animal are subject to damaging contact with other objects. Such contact tends to reduce the life of the sleeve or cover. Objects such as spurs of a rider of the animal can contact the exposed outer periphery of the sleeve or cover causing unsightly gouges, marks, and scratches. This is particularly problematic for cinch or girth assemblies used with show animals where appearance of both the animal and equipment attached to the animal are important.

A protective guard for a saddle cinch or girth assembly that solved these problems would be a welcome improvement. Accordingly, an embodiment of the present invention includes a cinch or girth assembly for attaching a saddle to an animal. The cinch or girth assembly includes a web assembly having buckles secured thereto for connection to the saddle. Structure is provided for covering the web assembly to reduce abrasive contact between the web assembly and the animal. A portion of the periphery of the covering structure lies adjacent the animal. The cinch or girth assembly further includes structure, attached to an exposed portion of the periphery of the covering structure that lies away from the animal, that shields the covering structure from damaging contact with other objects.

The web assembly may include a first web to which the buckles are secured and a second web having a width greater than the first web that is attached to the first web. This first web may include first and second belts that are attached together. The second belt may be interposed between the first belt. The first and second belts may be secured to the buckles so that each forms first and second layers. These first layers may each have first ends that are attached together and to the second layers. The first layers further include second ends, opposite the first ends, that are also attached together and to the second layers.

The second web may include first and second layers that are attached together. The length of the second web may be greater than the length of the first web so that portions of the second web lie adjacent the buckles. These portions of the second web adjacent the buckles may be attached to the covering structure.

The covering structure may include an elastomeric sleeve in which the web assembly is disposed. This sleeve may be made of neoprene.

The shielding structure may include a sheet attached to the exposed portion of the periphery of the covering structure. This sheet has dimensions generally conforming to those of the exposed portion. This sheet may be made from leather, nylon, or jersey material.

A third web has rings secured to the ends thereof. The third web is attached to the second web so that the rings are generally perpendicular to the buckles and extend through the covering structure.

The cinch or girth assembly may further include structure interposed between the web assembly and the covering structure for reducing friction between the web assembly and the covering structure. The friction reducing structure may include a liner attached to the covering structure. This liner may be made from jersey material.

Another embodiment of the cinch or girth assembly includes an elastomeric sleeve having an inner periphery that defines a cavity and an outer periphery. A liner is attached to the inner periphery of the sleeve and a guard is attached to an exposed portion of the outer periphery of the sleeve. A web assembly is disposed within the cavity of the sleeve. This web assembly has buckles secured thereto for connecting to a saddle so that an unguarded portion of the outer periphery of the sleeve lies adjacent an animal.

The sleeve may be made from a folded elastomeric sheet having a first surface to which a liner is attached and a second surface generally opposite the first surface. The sheet is formed into a sleeve so that confronting longitudinal edges of the sheet are directed generally towards the cavity defined by the sleeve. These edges are secured together. In one embodiment, the sleeve is made of neoprene.

The guard may include a sheet that has dimensions generally conforming to the exposed portion of the outer periphery of the sleeve. The sheet may be made from leather, nylon, or jersey material.

The web assembly may include a first web to which buckles are secured and a second web, having a width greater than the width of the first web, attached to the first web. Longitudinal edges of the second web extend beyond longitudinal edges of the first web. Portions of the second web adjacent the buckles may be attached to the sleeve. The first and second webs may, in cooperation with the inner periphery of the sleeve, define pockets adjacent the longitudinal edges of the first and second webs and the inner periphery.

A further embodiment of the present invention includes a cinch or girth assembly for attaching a saddle to an animal. The cinch or girth assembly includes an elastomeric sheet having a first surface and a second surface. A liner is attached to the first surface of the sheet. Structure is provided for forming the sheet into a tubular sleeve having an inner periphery and an outer periphery. A liner is attached to the inner periphery which defines a cavity. A portion of the outer periphery is formed from the first surface of the sheet having the liner attached thereto. A web assembly having buckles secured thereto is disposed within the cavity of the sleeve. The buckles connect the cinch or girth assembly to the saddle so that the unlined portion of the outer periphery of the sleeve lies adjacent the animal.

The elastomeric sheet may be made of neoprene. The sleeve may have a first thickness adjacent the animal and a second thickness generally opposite the first thickness. The second thickness may be greater than the first thickness. The second thickness may include first and second layers of the sheet that are secured to the first thickness by the forming structure. The liner may be made of jersey material.

Other objects, advantages and novel features of the present invention will become apparent from the following detailed description of the invention when considered in conjunction with the accompanying drawings.

DETAILED DESCRIPTION OF THE DRAWINGS

Figure 1:
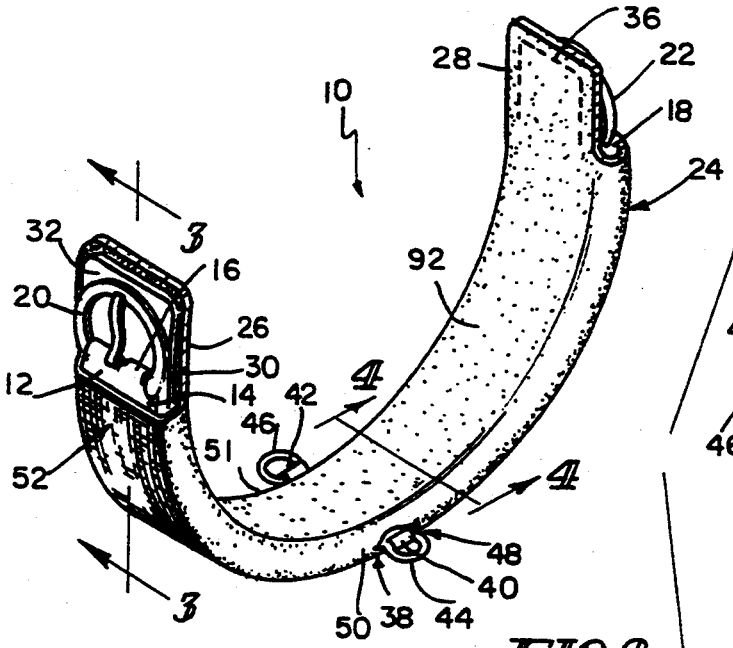
FIG. 1 is a perspective view of a saddle cinch or girth assembly in accordance with the present invention showing a cinch or girth disposed within a sleeve or non-rub cover having a protective guard attached to an exposed periphery.

A cinch or girth assembly 10 used to attach a saddle to an animal is shown in FIG. 1. Cinch or girth assembly 10 encircles the underside of an animal (not shown in FIG. 1) such as a horse near the front of the legs of the animal. Cinch or girth assembly 10 includes a web assembly 12 that has a first web or belt 14 with opposing ends 16 and 18 to which respective buckles 20 and 22 are secured. Buckles 20 and 22 engage straps of the saddle to secure the saddle to the animal. In a preferred embodiment, buckles 20 and 22 are generally flat. The flatness of buckles 20 and 22 provides additional surface area contact with the animal over that provided by rounded buckles. The flatness of buckles 20 and 22 helps cinch or girth assembly 10 to resist twisting when attached to the animal. Also in the preferred embodiment, first web 14 is made of high strength nylon.

Web assembly 12 tends to abrasively wear the skin of an animal with which it is in contact. To alleviate this problem, web assembly 14 is disposed within a sleeve or non-rub cover 24. Sleeve 24 includes buckle guard portions 26 and 28 that extend beyond first web 14 and lie adjacent respective buckles 20 and 22. Buckle guard portions 26 and 28 shield buckles 20 and 22 from direct contact with the skin of the animal. Sleeve 24 is made from a soft elastomeric material such as neoprene that helps reduce abrasive contact between web assembly 12 and the animal.

Figure 2:
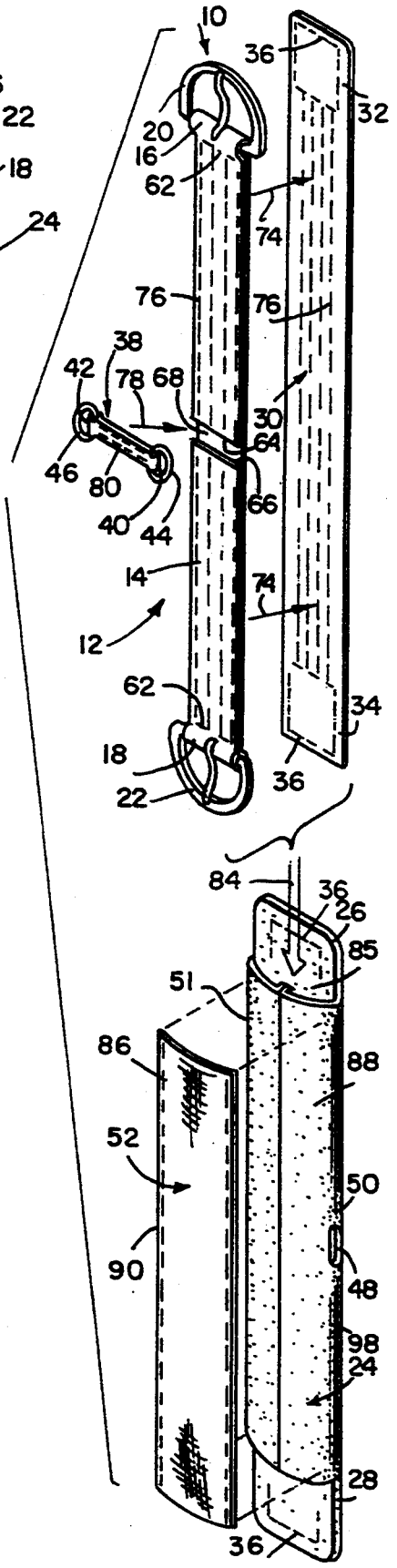
FIG. 2 is an exploded assembly view of a web assembly that includes a first web having buckles on the ends thereof, a second web to which the first web is attached, and a third web with rings on the ends thereof that is attached to the first web, the web assembly is disposed within a sleeve or non-rub cover that has a protective guard attached to an exposed periphery.

Web assembly 12 further includes a second web 30 having buckle guard portions 32 and 34 that lie interposed between buckles 20 and 22 and buckle guard portions 26 and 28 of sleeve 24 as shown in FIG. 2. Buckle guard portions 32 and 34 of second web 30 help reduce abrasive contact between buckles 20 and 22 and buckle guard portions 26 and 28 of sleeve 24. Buckle guard portions 32 and 34 of second web 26 may be secured to sleeve 24 by stitching 36. In the preferred embodiment, second web 30 is made from nylon that does not have to be as structurally strong as the nylon from which first web 14 is made.

Web assembly 12 further includes a third web or ring strap 38 that has opposing ends 40 and 42 to which respective rings 44 and 46 are secured. Rings 44 and 46 extend through openings 48 formed through sides 50 and 51 of sleeve 24. Ring 44 attaches to a tie down or, alternatively, to a breast collar of the saddle. Ring 46 attaches to a flank strap of a girth on the back of the saddle. In the preferred embodiment, third web 38 is also made of nylon. Although cinch or girth assembly 10 is shown as including a web assembly 12 made from a plurality of nylon webs, it is to be understood that cinch or girth assembly 10 may, alternatively, include a one or multi-piece web assembly made of leather, rope, or cord.

Outer peripheral portions of sleeve 24 not in contact with the animal are subject to damaging contact with objects such as spurs of a rider of the animal. Such contact often leaves unsightly gouges, marks, and scratches. This contact is particularly problematic for cinch or girth assemblies 10 used with show animals where the appearance of both the animal and equipment attached to the animal is important. An additional problem with such contact is that items may be caught in the sleeve 24 and require removal. A further problem with such contact is that it tends to reduce the life of sleeve 24. These removed portions create debris and litter. To alleviate these problems, a protective guard or shield 52 is attached to a portion of sleeve 24 away from the animal as will be discussed in more detail below. Guard 52 may be made from leather, nylon, or jersey material which is generally more resistant to gouges, marks, and scratches caused by objects such as spurs than the soft elastomeric material from which sleeve 24 is made.

Figure 3:
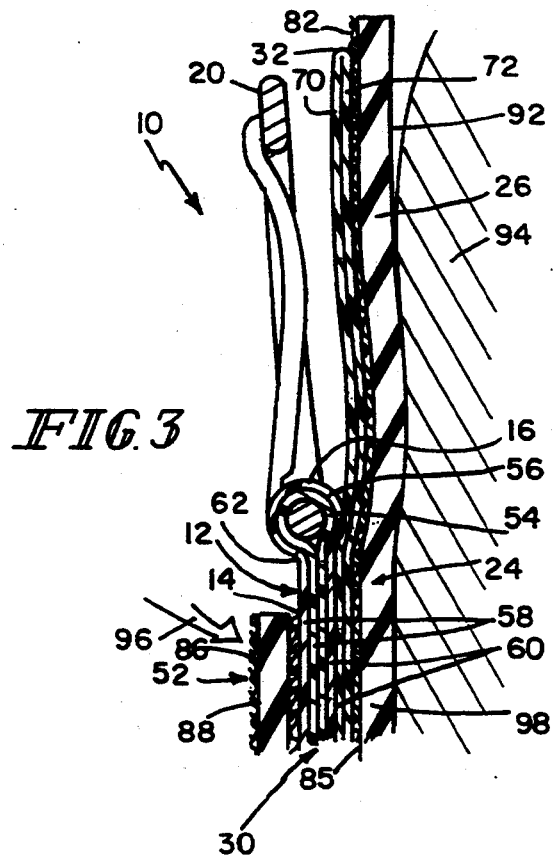
FIG. 3 is an end view taken along line 3—3 of FIG. 1 showing an end of the invention in contact with an animal.

In a preferred embodiment, first web 14 is made from first and second belts 54 and 56 as shown in FIG. 3. Use of two belts 54 and 56 helps provide strength to first web 14. First and second belts 54 and 56 are secured around buckles 20 and 22 so that first and second layers 58 and 60 are formed for each belt. Stitching 62 shown in FIGS. 2 and 3 is used to secure first and second belts 54 and 56 around buckles 20 and 22.

First and second ends 64 and 66 of first layers 58 of belts 54 and 56 are arranged in confronting relationship as shown in FIG. 2 and secured to second layers 60. An opening 68 is formed between first and second ends 64 and 66 of first layers 58 of first and second belts 54 and 56. Opening 68 provides a recessed space for receiving and securing third web 38 to first web 14. Second web 30 includes first and second layers 70 and 72 as shown in FIG. 3. Use of two layers helps provide strength to second web 30.

Arrows 74 shown in FIG. 2 generally indicate the attachment of first web 14 to second web 30 by stitching 76. Arrow 78 also shown in FIG. 2 generally indicates the attachment of third web 38 to first web 14 within opening 68 by stitching 80.

A liner 82 shown in FIG. 3 provides a structure for reducing friction between first, second, and third webs 14, 30, and 38 when they are inserted into sleeve 24 as generally indicated by large arrow 84 shown in FIG. 2. Liner 82 is attached to inner periphery 85 of sleeve 24. In the preferred embodiment, liner 82 is made from a jersey material. Liner 82 also helps prevent web assembly 12 from wearing away inner periphery 85 of sleeve 24.

Protective guard 52 is shown in FIG. 2 as being formed from a sheet 86 having dimensions that generally conform to those of exposed periphery 88 of sleeve 24. As mentioned above, sheet 86 of guard 52 can be made from items such as leather, nylon, or jersey material. In the embodiment of cinch or girth assembly 10 shown in FIGS. 1–5, sheet 86 is made from the same jersey material as liner 82. Sheet 86 is attached to exposed periphery 88 by stitching 90. Sheet 86 can also be made from a variety of colors so that the appearance of cinch or girth assembly 10 can be readily changed.

Figure 4:
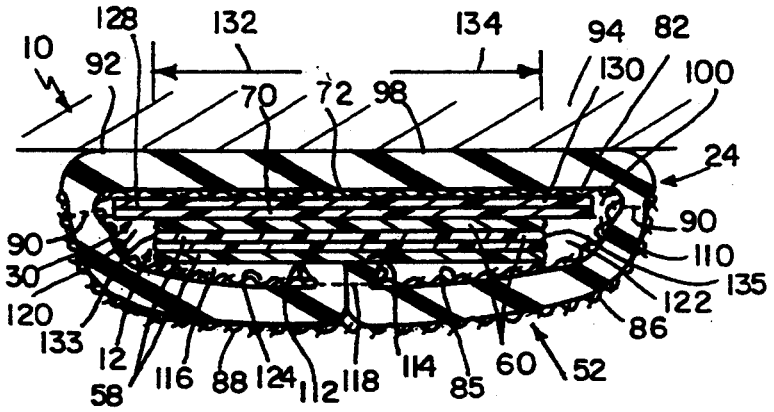
FIG. 4 is a view of the invention taken along line 4—4 of FIG. 1 showing a side view of the invention in contact with an animal.
Figure 5:
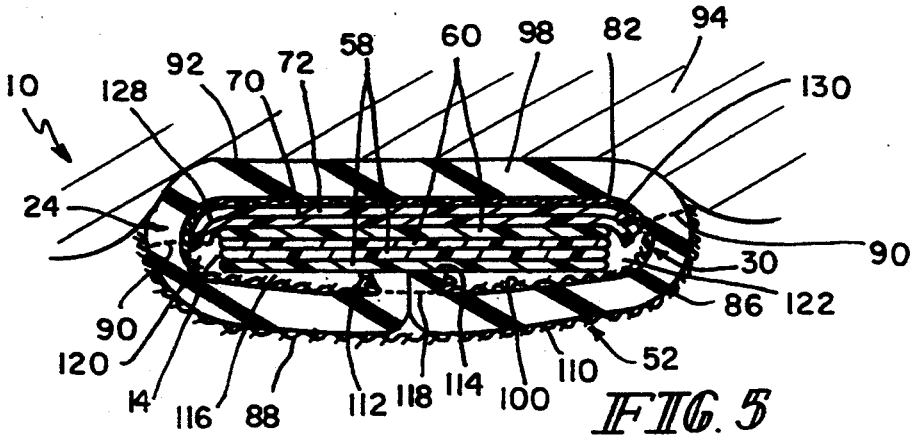
FIG. 5 is a view of FIG. 4 with the web assembly tightened around the animal.

Buckles 20 and 22 and rings 44 and 46 attach cinch or girth assembly 10 to a saddle so that an unguarded periphery 92 of sleeve 24 lies adjacent an animal 94 as shown in FIGS. 3–5. Because sleeve 24 is made from a soft elastomeric material such as neoprene, abrasive contact between animal 94 and cinch or girth assembly 10 is reduced. However, as discussed above, the relative softness of sleeve 24 has the disadvantage of subjecting exposed periphery 88 to damaging contact with objects such as spurs of a rider of animal 94. An example of the direction of such damaging contact (to an unshielded sleeve 24) is generally indicated by large arrow 96 in FIG. 3. This contact can cause gouges, marks, and scratches in exposed periphery 88. Sheet 86 of protective guard 52 shields against such damaging contact and thereby eliminates problems associated with unguarded sleeves 24.

In the embodiment illustrated in FIGS. 1–5, sleeve 24 is formed from an elastomeric sheet 98 having first and second surfaces 100 and 110. Sleeve 24 is formed in the generally tubular shape shown in FIGS. 1, 2, 4, and 5 by folding elastomeric sheet 98 so that confronting longitudinal ends 112 and 114 are directed generally towards a cavity 116 and secured by stitching 118. Cavity 116 is defined by inner periphery 85 or first surface 100 to which liner 82 is attached.

First and second webs 14 and 30 in cooperation with a first surface 124 of liner 82 define pockets 120 and 122. Pockets 120 and 122 provide a space into which extended width portions 128 and 130 of second web 30 can deflect during tightening of first web 14 of cinch or girth assembly 10 around animal 94 as shown in FIG. 5. The area of force distribution applied by first web 14 on second web 30, sleeve 24, and animal 94 is generally indicated by arrows 132 and 134. As can be appreciated from the combination of FIGS. 4 and 5, extended width portions 128 and 130 of second web 30 help maintain the shape of sleeve 24 when first web 14 is tightened so that the portions of unguarded periphery 92 which extend beyond longitudinal edges 133 and 135 of first web 14 remain in contact with animal 94.

Figure 6:
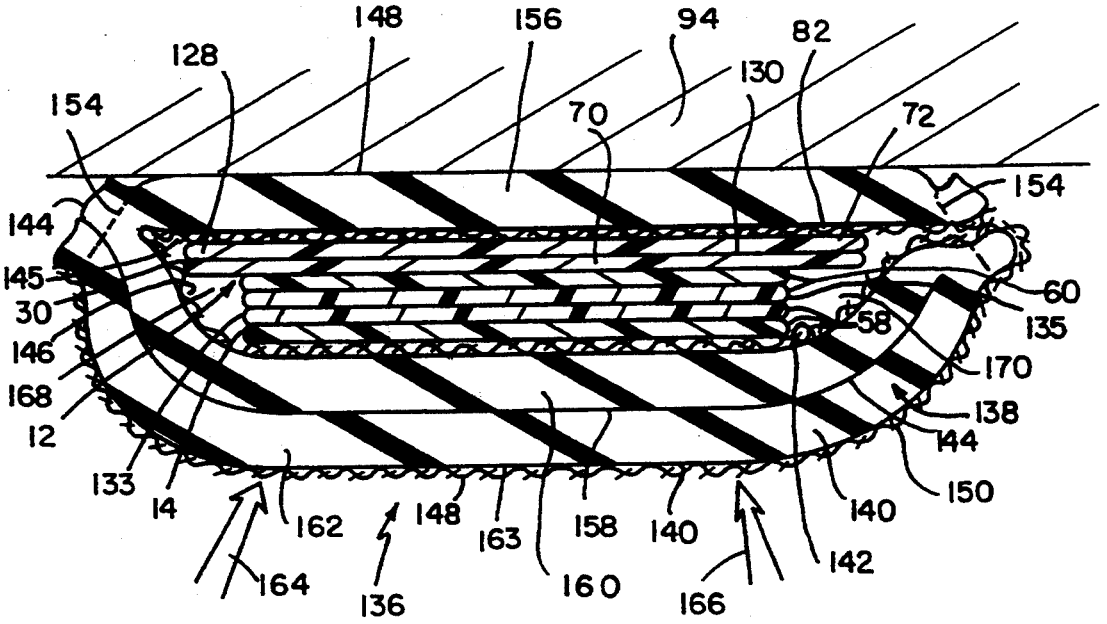
FIG. 6 is an alternative embodiment of a saddle cinch or girth assembly of the invention with the sleeve or non-rub cover folded back over itself to form a double thickness on a side of the sleeve or cover away from the animal.

FIG. 6 shows an alternative embodiment of a cinch or girth assembly 136 of the present invention that includes web assembly 12 disposed within a sleeve 138. Sleeve 138 is formed from an elastomeric sheet 140 having a first surface 142 and a second surface 144 generally opposite first surface 142. In a preferred embodiment, elastomeric sheet is made of neoprene. Liner 82 is attached to first surface 142 of sheet 140. Sheet 140 is formed into generally tubularly-shaped sleeve 138 so that a first surface 145 of liner 82 defines an inner periphery 146 adjacent web assembly 12 and a portion of second surface 144 of sheet 140 adjacent animal 94 and a portion of first surface 145 of liner 82 away from animal 94 together define an outer periphery 148. Liner 82 on a portion of outer periphery 148 forms a protective guard or shield 150. Sheet 140 is secured into the generally tubular shape shown in FIG. 6 by stitching 154. Sleeve 138 is formed so that it has a first thickness 156 adjacent animal 94 and a second thickness 158 generally lying away from animal 94. Second thickness 158 includes first and second layers 160 and 162 formed when sheet 140 is folded over itself and secured by stitching 154 to expose liner 82 and thereby form protective guard 150.

As with protective guard 52 of cinch or girth assembly 10, protective guard 150 shields exposed periphery 163 of sleeve 138 from damaging contact by items such as spurs of a rider of animal 94. Examples of directions of such damaging contact are generally indicated by large arrows 164 and 166.

First and second webs 14 and 30 in cooperation with first surface 145 of liner 82 define pockets 168 and 170. As with pockets 120 and 122, pockets 168 and 170 provide a space in which extended width portions 128 and 130 of second web 30 can deflect when first web 14 is tightened around animal 94. Extended width portions 128 and 130 help maintain the shape of sleeve 138 when web 14 is tightened so that unguarded portions of outer periphery 148 which extend beyond longitudinal edges 133 and 135 of first web 14 remain in contact with animal 94.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A cinch or girth assembly for attaching a saddle to an animal, comprising:

a web assembly having a longitudinal length between first and second opposing ends to which buckles are secured for connection to the saddle;

means for covering the web assembly to reduce abrasive contact between the web assembly and animal, a portion of a periphery of the covering means lying adjacent the animal; and means attached to the covering means and extending adjacent the longitudinal length of the web assembly for shielding the covering means from damaging contact with other objects.

2. The cinch or girth assembly of claim 1, wherein the covering means includes an elastomeric sleeve in which the web assembly is disposed.

3. The cinch or girth assembly of claim 2, wherein the sleeve is made of neoprene.

4. The apparatus of claim 1, wherein the covering means is made of neoprene and the shielding means is made of one of leather, nylon, and jersey material.

5. A cinch or girth assembly for attaching a saddle to an animal, comprising:

an elastomeric sleeve having an inner periphery that defines a cavity and an outer periphery;

a liner attached to the inner periphery of the sleeve;

a web assembly disposed within the cavity of the sleeve, the web assembly having buckles secured thereto for connection to the saddle so that a portion of the outer periphery of the sleeve lies adjacent the animal; and a guard positioned adjacent an exposed portion of the outer periphery of the sleeve, the guard including a pair of opposing sides attached to the elastomeric sleeve and a pair of opposing ends that are unattached to the elastomeric sleeve and the web assembly.

6. The cinch or girth assembly of claim 5, wherein the sleeve includes a folded elastomeric sheet having a first surface to which the liner is attached, a second surface generally opposite the first surface, and confronting longitudinal edges that are directed generally towards the cavity defined by the sleeve and secured together.

7. The cinch or girth assembly of claim 5, wherein the sleeve is made of neoprene.

8. The cinch or girth assembly of claim 5, wherein the guard includes a sheet having dimensions generally conforming to the exposed portion of the outer periphery of the sleeve.

9. The cinch or girth assembly of claim 8, wherein the sheet is made of one of leather, nylon, or jersey material.

10. The cinch or girth assembly of claim 5, wherein the web assembly includes a first web to which the buckles are secured and a second web attached to the first web and having a width greater than a width of the first web so that longitudinal edges of the second web extend beyond longitudinal edges of the first web.

11. The cinch or girth assembly of claim 10, wherein portions of the second web adjacent the buckles are attached to the sleeve.

12. The cinch or girth assembly of claim 10, wherein the first and second webs in cooperation with the inner periphery of the sleeve define pockets adjacent the longitudinal edges of the first and second webs and the inner periphery.

13. A cinch or girth assembly for attaching a saddle to an animal, comprising:

an elastomeric sheet having a first surface and a second surface;

a liner attached to the first surface of the sheet;

means for forming the sheet into a tubular sleeve having an inner periphery to which the liner is attached, the inner periphery defining a cavity, and an outer periphery, a portion of which is formed from the first surface of the sheet having the liner attached thereto; and a web assembly disposed within the cavity of the sleeve, the web assembly having buckles secured thereto for connection to the saddle so that an unlined portion of the outer periphery of the sleeve lies adjacent the animal.

14. The cinch or girth assembly of claim 13, wherein the elastomeric sheet is made of neoprene.

15. The cinch or girth assembly of claim 13, wherein the sleeve has a first thickness adjacent the animal and second thickness generally opposite the first thickness.

16. The cinch or girth assembly of claim 15, wherein the second thickness is greater than the first thickness.

17. The cinch or girth assembly of claim 16, wherein the second thickness includes first and second layers of the sheet secured to the first thickness by the forming means.

18. The cinch or girth assembly of claim 13, wherein the liner is made of jersey material.

19. A cinch or girth assembly for attaching a saddle to an animal, comprising:

a web assembly having buckles secured thereto for connection to the saddle;

means for covering the web assembly to reduce abrasive contact between the web assembly and animal, a portion of a periphery of the covering means lying adjacent the animal; and means attached to an exposed portion of the periphery of the covering means lying away from the animal for shielding the covering means from damaging contact with other objects;

wherein the web assembly includes a first web to which the buckles are secured and a second web attached to the first web and having a width greater than a width of the first web; and wherein the first web includes first and second belts that are attached together and folded around the buckles.

20. The cinch or girth assembly of claim 19, wherein the first and second belts are secured to the buckles so that each forms a first and a second layer, the first layer of each belt having a first end that is attached to the first end of the other belt as well as to the second layers and an opposing second end that is attached to the second end of the other belt as well as to the second layers.

21. A cinch or girth assembly for attaching a saddle to an animal, comprising:

a web assembly having buckles secured thereto for connection to the saddle, the web assembly including a first web to which the buckles are secured and a second web attached to the first web and having a width greater than a width of the first web;

means for covering the web assembly to reduce abrasive contact between the web assembly and animal, a portion of a periphery of the covering means lying adjacent the animal; and means attached to an exposed portion of the periphery of the covering means lying away from the animal for shielding the covering means from damaging contact with other objects; and a third web attached to the first web and having rings secured to ends thereof such that the rings are generally perpendicular to the buckles and extend through the covering means.

22. A cinch or girth assembly for attaching a saddle to an animal, comprising:

a web assembly having buckles secured thereto for connection to the saddle, the web assembly including a first web to which the buckles are secured and a second web attached to the first web and having a width greater than a width of the first web;

means for covering the web assembly to reduce abrasive contact between the web assembly and animal, a portion of a periphery of the covering means lying adjacent the animal; and means attached to an exposed portion of the periphery of the covering means lying away from the animal for shielding the covering means from damaging contact with other objects.

23. The cinch or girth assembly of claim 22, wherein the first web includes first and second belts that are attached together.

24. The cinch or girth assembly of claim 22, wherein the second web includes first and second layers that are attached together.

25. The cinch or girth assembly of claim 22, wherein the length of the second web is greater than the length of the first web such that portions of the second web lie adjacent the buckles.

26. The cinch or girth assembly of claim 25, wherein the portions of the second web adjacent the buckles are attached to the covering means.

27. A cinch or girth assembly for attaching a saddle to an animal, comprising:

a web assembly having buckles secured thereto for connection to the saddle;

means for covering the web assembly to reduce abrasive contact between the web assembly and animal, a portion of a periphery of the covering means lying adjacent the animal; and means attached to an exposed portion of the periphery of the covering means lying away from the animal for shielding the covering means from damaging contact with other objects, the shielding means including a sheet attached to the exposed portion of the periphery of the covering means and having dimensions generally conforming to the exposed portion.

28. The cinch or girth assembly of claim 27, wherein the sheet is made of one of leather, nylon, or jersey material.

29. A cinch or girth assembly for attaching a saddle to an animal, comprising:

a web assembly having buckles secured thereto for connection to the saddle;

means for covering the web assembly to reduce abrasive contact between the web assembly and animal, a portion of a periphery of the covering means lying adjacent the animal;

means attached to an exposed portion of the periphery of the covering means lying away from the animal for shielding the covering means from damaging contact with other objects; and means between the web assembly and the covering means for reducing friction between the web assembly and covering means.

30. The cinch or girth assembly of claim 29, wherein the friction reducing means includes a liner attached to the covering means.

31. The cinch or girth assembly of claim 30, wherein the liner includes jersey material.

32. A cinch or girth assembly for attaching a saddle to an animal, comprising:

a cinch or girth having a longitudinal length located between first and second opposing ends of the cinch or girth;

means secured to the first and second ends of the cinch or girth for connecting to the saddle;

an elastomeric sheet of non-rub material that is positioned to lie adjacent the cinch or girth so that the elastomeric sheet lies between the animal and the cinch or girth to help reduce abrasive contact between the cinch or girth and the animal;

a protective guard that includes a wear-resistant sheet made from a different material than that of the elastomeric sheet, the protective guard including a pair of opposing sides and a pair of opposing ends; and means for attaching the opposing sides of the protective guard to the elastomeric sheet so that the protective guard is positioned to lie away from the animal and to extend adjacent the longitudinal length of the cinch or girth, the opposing ends of the protective guard being unattached to both the elastomeric sheet and the cinch or girth.

33. The apparatus of claim 32, wherein the elastomeric sheet is made of neoprene and the wear-resistant sheet of the protective guard is made of one of leather, nylon, and jersey material.

34. The apparatus of claim 32, further comprising a liner attached to a first surface of the elastomeric sheet so that the liner is positioned to lie between the elastomeric sheet and the cinch or girth to reduce friction between the elastomeric sheet and the cinch or girth.

35. The apparatus of claim 32, wherein the connecting means includes buckles secured to the first and second opposing ends of the cinch or girth and rings positioned on opposite sides of and generally in a middle of the cinch or girth, and further wherein the elastomeric sheet is configured so that the rings extend through openings in the sheet and the elastomeric sheet lies between the buckles and the animal.

36. The apparatus of claim 35, further comprising buckle guard portions positioned to lie between the buckles and portions of the elastomeric sheet adjacent the buckles to help reduce abrasive contact between the buckles and the elastomeric sheet.

37. The apparatus of claim 36, wherein the buckle guard portions are made from nylon.

38. The apparatus of claim 32, wherein the elastomeric sheet includes a pair of edges on opposing sides of and extending generally parallel to a longitudinal axis of the elastomeric sheet that are secured together to form a sleeve into which the cinch or girth is positioned to lie.

39. The apparatus of claim 32, wherein the attaching means includes stitching.

40. An apparatus for use with a cinch or girth, comprising:

an elastomeric sheet of non-rub material having an inside surface and an outside surface;

a web positioned adjacent and attached to the inside surface of the elastomeric sheet; and a protective guard that includes a wear-resistant sheet made from a different material than the material from which the elastomeric sheet is made, the protective guard including a pair of opposing sides attached to the elastomeric sheet and a pair of opposing free ends that are unattached to the elastomeric sheet whereby the cinch or girth is positionable between the protective guard and the web so that, when the cinch or girth is attached to a saddle on an animal, the outside surface of the elastomeric sheet is positioned adjacent the animal.

41. The apparatus of claim 40, wherein the elastomeric sheet is made of neoprene and the wear-resistant sheet of the protective guard is made of one of leather, nylon, and jersey material.

42. The apparatus of claim 40, wherein the elastomeric sheet includes a pair of edges on opposing sides of and extending generally parallel to a longitudinal axis of the elastomeric sheet that are secured together to form a sleeve into which the cinch or girth is insertable.

43. The apparatus of claim 40, wherein the elastomeric sheet is configured to include a pair of openings generally in the middle thereof through which rings of the cinch or girth extend.

44. The apparatus of claim 40, further comprising buckle guard portions positioned adjacent the inside surface of the elastomeric sheet so that the guard portions lie between the elastomeric sheet and buckles of the cinch or girth to help reduce abrasive contact between the buckles and the elastomeric sheet.

45. The apparatus of claim 44, wherein the buckle guard portions are made from one of leather and nylon.

* * * * *